US010413076B2

(12) United States Patent
Flora

(10) Patent No.: US 10,413,076 B2
(45) **Date of Patent: *Sep. 17, 2019**

(54) FOLDING BED FOR SPACE SAVING STORAGE WITHIN A CABINET

(71) Applicant: Iqbal Singh Flora, Abbotsford (CA)

(72) Inventor: Iqbal Singh Flora, Abbotsford (CA)

( * ) Notice: Subject to any disclaimer, the term of this patent is extended or adjusted under 35 U.S.C. 154(b) by 291 days.

This patent is subject to a terminal disclaimer.

(21) Appl. No.: 15/295,650

(22) Filed: Oct. 17, 2016

(65) Prior Publication Data

US 2017/0035207 A1 Feb. 9, 2017

Related U.S. Application Data

(62) Division of application No. 14/340,502, filed on Jul. 24, 2014, now Pat. No. 9,468,305.

(51) Int. Cl.

| | |
|---|---|
| ***A47C 17/60*** | (2006.01) |
| ***A47C 17/52*** | (2006.01) |
| ***A47C 17/58*** | (2006.01) |

(52) U.S. Cl.

CPC ..... *A47C 17/60* (2013.01); *A47C 17/52* (2013.01); *A47C 17/58* (2013.01)

(58) Field of Classification Search

CPC ..... A47C 17/52; A47C 17/58; A47C 17/60

See application file for complete search history.

(56) References Cited

U.S. PATENT DOCUMENTS

| | | | |
|---|---|---|---|
| 3,792 | A | 10/1844 | Kingman |
| 67,816 | A | 8/1867 | Stock |
| 74,494 | A | 2/1868 | Burr |
| 83,936 | A | 11/1868 | Crosby |
| 85,232 | A | 12/1868 | Maynard |
| 95,076 | A | 9/1869 | Brander |
| 102,012 | A | 4/1870 | Kelly |

(Continued)

FOREIGN PATENT DOCUMENTS

| | | | |
|---|---|---|---|
| CN | 87 208 349 | W | 5/1987 |
| CN | 2114352 | U | 9/1992 |

(Continued)

OTHER PUBLICATIONS

U.S. Appl. No. 14/340,502, filed Jul. 24, 2014.

(Continued)

*Primary Examiner* — Eric J Kurilla

(74) *Attorney, Agent, or Firm* — Renner, Otto, Boisselle & Sklar, LLP

(57) ABSTRACT

A folding bed for storage within a cabinet has a flat platform made from a front panel and an inside front panel. Rear extension panels are hingedly attached to the rear face of a drawer such that in the closed cabinet position the rear extension panels are parallel to the rear drawer face and moveable when in the open bed position to be parallel with the side drawer faces. The cabinet sides and the cabinet top have hinges to permit opening up the upper structural section.

A method of transforming an apparatus from a cabinet to a bed pulling out a base drawer involves unfolding panels to form a platform out of a front panel, an inside panel and a cabinet floor, unfolding a mattress from within the apparatus onto the platform, and unfolding side panels to reduce visible obstructions.

26 Claims, 7 Drawing Sheets

(56) References Cited

U.S. PATENT DOCUMENTS

| | | | | | |
|---|---|---|---|---|---|
| 107,881 | A | | 10/1870 | Crosby | |
| 119,079 | A | | 9/1871 | Crosby | |
| 155,476 | A | | 9/1874 | Trevitt | |
| 156,986 | A | | 11/1874 | Crosby | |
| 179,013 | A | | 6/1876 | Green | |
| 186,632 | A | | 1/1877 | Smith | |
| 189,303 | A | | 4/1877 | Crosby | |
| RE8,270 | E | | 6/1878 | Main | |
| RE8,375 | E | | 8/1878 | Kiss | |
| 219,342 | A | | 9/1879 | Boyington | |
| 220,173 | A | | 9/1879 | Reichkert | |
| 225,393 | A | | 3/1880 | Kendrick | |
| 230,397 | A | | 7/1880 | Boyington | |
| 239,805 | A | | 3/1881 | Knapp | |
| 253,903 | A | * | 2/1882 | Witmer | A47C 19/122 5/152 |
| 261,006 | A | | 7/1882 | Logan | |
| 261,053 | A | | 7/1882 | Shupe | |
| 262,817 | A | | 8/1882 | Morrison | |
| 310,343 | A | | 1/1885 | Warren | |
| 391,424 | A | | 10/1888 | Poulson | |
| 417,108 | A | | 12/1889 | Snyder | |
| 431,825 | A | | 7/1890 | Sundback | |
| 433,845 | A | * | 8/1890 | Argerbright | A47C 17/40 5/138 |
| 445,629 | A | | 2/1891 | Osgood | |
| 445,777 | A | | 2/1891 | Goodwillie | |
| 476,923 | A | | 6/1892 | Hayton et al. | |
| 504,778 | A | | 9/1893 | Flory | |
| 510,084 | A | | 12/1893 | Odegaard et al. | |
| 547,170 | A | | 10/1895 | Karp | |
| 637,670 | A | * | 11/1899 | Sanor | A47C 17/58 5/147 |
| 673,536 | A | | 5/1901 | Hamilton | |
| 756,162 | A | | 3/1904 | Faschian | |
| 791,857 | A | | 6/1905 | Arnold | |
| 915,651 | A | | 3/1909 | Appel | |
| 939,482 | A | | 11/1909 | Douglass | |
| 1,073,674 | A | | 9/1913 | Giordano | |
| D45,708 | S | | 1/1914 | Giordano | |
| 1,087,679 | A | | 2/1914 | Page | |
| 1,121,636 | A | | 12/1914 | Kreczkowski | |
| 1,170,149 | A | | 2/1916 | Gustafson | |
| 1,184,156 | A | | 5/1916 | Winkler | |
| 1,186,202 | A | | 6/1916 | Jasinski | |
| 1,253,872 | A | | 1/1918 | Page | |
| 1,331,599 | A | * | 2/1920 | Vohralik | A47C 17/48 108/33 |
| 1,338,741 | A | | 4/1920 | Lipshitz | |
| 1,368,101 | A | * | 2/1921 | Bettegar | A47C 17/60 5/149 |
| 1,409,770 | A | | 3/1922 | Piatkowski | |
| 1,413,595 | A | | 4/1922 | Kreuzkamp | |
| 1,558,012 | A | * | 10/1925 | Oliver | A47C 17/48 5/141 |
| 1,618,642 | A | * | 2/1927 | Diamond | A47C 17/58 5/149 |
| 1,795,697 | A | * | 3/1931 | Abela | A47C 17/48 5/154 |
| 2,313,847 | A | | 3/1943 | Thomas | |
| 2,356,321 | A | | 8/1944 | Irick | |
| 2,462,524 | A | | 2/1949 | Mattedi | |
| D159,608 | S | | 8/1950 | Godschalk | |
| 2,547,863 | A | | 4/1951 | Godschalk | |
| 2,618,789 | A | | 11/1952 | Kane | |
| 2,788,528 | A | | 4/1957 | Hansen | |
| 2,835,904 | A | | 5/1958 | Von Ehr | |
| 2,856,612 | A | | 10/1958 | Wheeler | |
| 3,097,369 | A | | 7/1963 | Emch | |
| 3,224,015 | A | | 12/1965 | Schneider | |
| 3,385,631 | A | | 3/1968 | Gertler | |
| 3,638,249 | A | | 2/1972 | Katsigarakis | |
| 3,749,465 | A | | 7/1973 | Newcomer | |
| 3,755,832 | A | | 9/1973 | Bennett | |
| 3,828,375 | A | | 8/1974 | Driver | |
| 3,852,837 | A | * | 12/1974 | Eakins | A47C 17/58 5/136 |
| 3,858,253 | A | * | 1/1975 | Lauzon | A47C 17/52 312/279 |
| 3,965,498 | A | | 6/1976 | Boni | |
| 4,793,011 | A | | 12/1988 | Eve | |
| 4,999,865 | A | * | 3/1991 | Sauder | A47C 17/58 5/149 |
| 5,036,558 | A | | 8/1991 | Lameka | |
| 5,446,932 | A | | 9/1995 | Voorhis | |
| D369,247 | S | | 4/1996 | Anderson | |
| 5,601,348 | A | | 2/1997 | Minkovski | |
| 5,611,414 | A | | 3/1997 | Walker | |
| D388,632 | S | | 1/1998 | Kelley | |
| 5,913,769 | A | | 6/1999 | Byma et al. | |
| D443,997 | S | | 6/2001 | Stout | |
| 6,401,276 | B1 | | 6/2002 | Sherman | |
| 6,425,151 | B2 | | 7/2002 | Barnett | |
| 6,463,603 | B1 | | 10/2002 | Camfield | |
| 6,851,139 | B2 | | 2/2005 | Arason et al. | |
| D508,796 | S | | 8/2005 | Juneau | |
| 7,013,506 | B2 | | 3/2006 | Revels | |
| D530,938 | S | | 10/2006 | Netto et al. | |
| 7,425,045 | B2 | | 9/2008 | Harari et al. | |
| 7,574,758 | B2 | | 8/2009 | Arason et al. | |
| D608,560 | S | | 1/2010 | Chen | |
| 7,793,366 | B2 | | 9/2010 | Stoltzfus | |
| 3,407,830 | A1 | | 4/2013 | Kumar | |
| 8,566,980 | B2 | | 10/2013 | Grone | |
| 8,572,776 | B2 | | 11/2013 | Grubb | |
| D712,676 | S | * | 9/2014 | Flora | D6/384 |
| D742,136 | S | * | 11/2015 | Flora | D6/384 |
| D814,830 | S | | 4/2018 | Flora | |
| 2004/0093669 | A1 | * | 5/2004 | Arason | A47C 19/122 5/159.1 |
| 2006/0031986 | A1 | * | 2/2006 | Revels | A47C 17/38 5/136 |
| 2006/0107456 | A1 | * | 5/2006 | Joseph | A47C 17/58 5/2.1 |
| 2006/0225210 | A1 | * | 10/2006 | Arason | A47C 17/48 5/159.1 |
| 2006/0230530 | A1 | * | 10/2006 | Avishay | A47C 17/38 5/136 |
| 2010/0263121 | A1 | * | 10/2010 | Arnold, IV | A47D 9/00 5/98.1 |
| 2016/0022048 | A1 | * | 1/2016 | Flora | A47C 17/58 5/149 |

FOREIGN PATENT DOCUMENTS

| | | | |
|---|---|---|---|
| CN | 2262848 | Y | 9/1997 |
| CN | 2507329 | Y | 8/2002 |
| CN | 201253024 | Y | 6/2009 |
| CN | 101596048 | A | 12/2009 |
| CN | 201767509 | U | 3/2011 |
| CN | 202698379 | U | 1/2013 |
| CN | 203000095 | U | 6/2013 |
| CN | 102783840 | A | 3/2016 |
| DE | 704678 | C | 4/1941 |
| EP | 2002758 | A1 | 12/2008 |
| FR | 364287 | A | 8/1906 |
| FR | 921179 | | 4/1947 |
| FR | 1369358 | | 8/1964 |
| GB | 726249 | A | 3/1955 |
| IT | 534716 | | 10/1955 |

OTHER PUBLICATIONS

Jerome Joseph, Collapsible Platform Bed with Integral Storage Chest, U.S. Appl. No. 60/630,347 of US 2006/0107456 published on May 25, 2006.

James Preston, Preston's Improvements in and relating to Combination Furniture, 1893.

* cited by examiner

FOLDING BED FOR SPACE SAVING STORAGE WITHIN A CABINET

CROSS REFERENCE TO RELATED APPLICATIONS

This is a continuation of U.S. patent application Ser. No. 14/340,502 which issued as U.S. Pat. No. 9,468,305 on Oct. 18, 2016.

TECHNICAL FIELD

This application relates to the field of foldable beds, and particularly to temporary beds that can be stored within a finished piece of furniture.

GOVERNMENT SUPPORT

None.

BACKGROUND

Beds take up a large amount of floor space within a room. When beds are not required frequently, or when the space is otherwise needed, it is helpful to have a bed that can be stored off the floor in a smaller footprint.

Various types of beds that can be folded away into furniture have been known for more than a century.

U.S. Pat. No. 179,013 titled "Improvement in Cabinet-Bedsteads" issued to Green on Jun. 20, 1876. Green disclosed a bed that folded up into a cabinet that had a functional bottom drawer that could be extended to partially support the bed. The unfolding and folding of the Green bed is cumbersome.

U.S. Pat. No. 7,574,758 to Arason et al. discloses a folding cabinet bed with a telescoping slide out support platform. The Arason bottom drawer loses considerable storage space due to the significant space taken up by multiple side panels and central panels. In operation as a bed, the Arason cabinet side walls do not open but remain as obstructions that may be undesirable to a person attempting to sleep in the bed.

There exists a need for collapsible bed that is comfortable and functional when used as a bed, but can also be easily folded up into an attractive piece of furniture so that valuable floor space no longer taken up by the bed when the bed is not in use.

SUMMARY OF INVENTION

Apparatus is provided for transforming a modified cabinet into a bed. An upper structural section has a rear cabinet panel and a cabinet top. The cabinet top is orthogonal to the rear cabinet panel and attached to the rear cabinet panel along a top edge. The two cabinet sides are orthogonal to the rear cabinet panel and orthogonal to the cabinet top. The cabinet sides are attached to the rear cabinet panel along a side edge.

Two side supports are provided on top of a cabinet floor, the side supports being sized and structured to support an underside of the cabinet top. A movable sleeping portion has a front cabinet panel hingedly attached along a bottom edge to the cabinet floor and an inside front panel hingedly attached along a top edge to the front cabinet panel. The front cabinet panel and the inside front panel are moveable between a closed position orthogonal to the cabinet floor and the cabinet top and parallel to the rear cabinet panel to an open position parallel to the cabinet floor and the cabinet top and orthogonal to the rear cabinet panel. A base section has two base side panels and a drawer having a front drawer face, a rear drawer face, and two side drawer faces. The drawer base is orthogonal to the front, rear and side drawer faces. Rear extension panels hingedly attached to the rear drawer face and to the base side panel such that when in the closed cabinet position the rear extension panels are parallel to the rear drawer face and moveable when in the open bed position to be parallel to the side drawer faces. A hinge bisects each of the cabinet sides. The cabinet sides are movable between a closed position where each bisected portion is coplanar and an open position where each bisected portion is parallel but not coplanar.

A hinge bisects the cabinet top, the cabinet top being movable between a closed position where each bisected portion is coplanar and an open position where each bisected portion is orthogonal. A central support can be provided on top of the cabinet floor, the central support being sized and structured to support an underside of the cabinet top.

The cabinet sides can be movable to an open position parallel to the rear cabinet panel.

In the open position, the visible width of the cabinet sides does not obstruct or block a side view through the upper structural section in at least a central portion of the upper structural section. The area opened up by opening the cabinet sides, in at least a central portion of the upper structural section can be more than half the width of the cabinet sides, and preferably at least 60% more open than when the cabinet sides are closed.

A locking mechanism can be attached to the side panels and to the cabinet front panel for releasably securing the side panels to the cabinet front panel.

Wheels are attached to an underside of the drawer base and wheels are attached to an underside of the rear extension panels.

A method for transforming an apparatus from a cabinet to a bed is provided in accordance with this invention. The method includes pulling out a base drawer, removing pillows and bedding from the base drawer, unlocking a locking mechanism securing a front cabinet panel to a side panel and folding the front cabinet panel down onto panels secured to a rear face of the base drawer. An inside front panel is unfolded onto the base drawer such that a a flat platform is formed out of the front cabinet panel, the inside front panel and a cabinet floor. A mattress can be unfolded from within the apparatus. The mattress can be laid onto the flat platform to form a bed. The cabinet side panels can be unfolded to to reduce visible obstructions.

BRIEF DESCRIPTION OF DRAWINGS

In Figures which illustrate non-limiting embodiments of the invention.

DESCRIPTION

Figure 1:
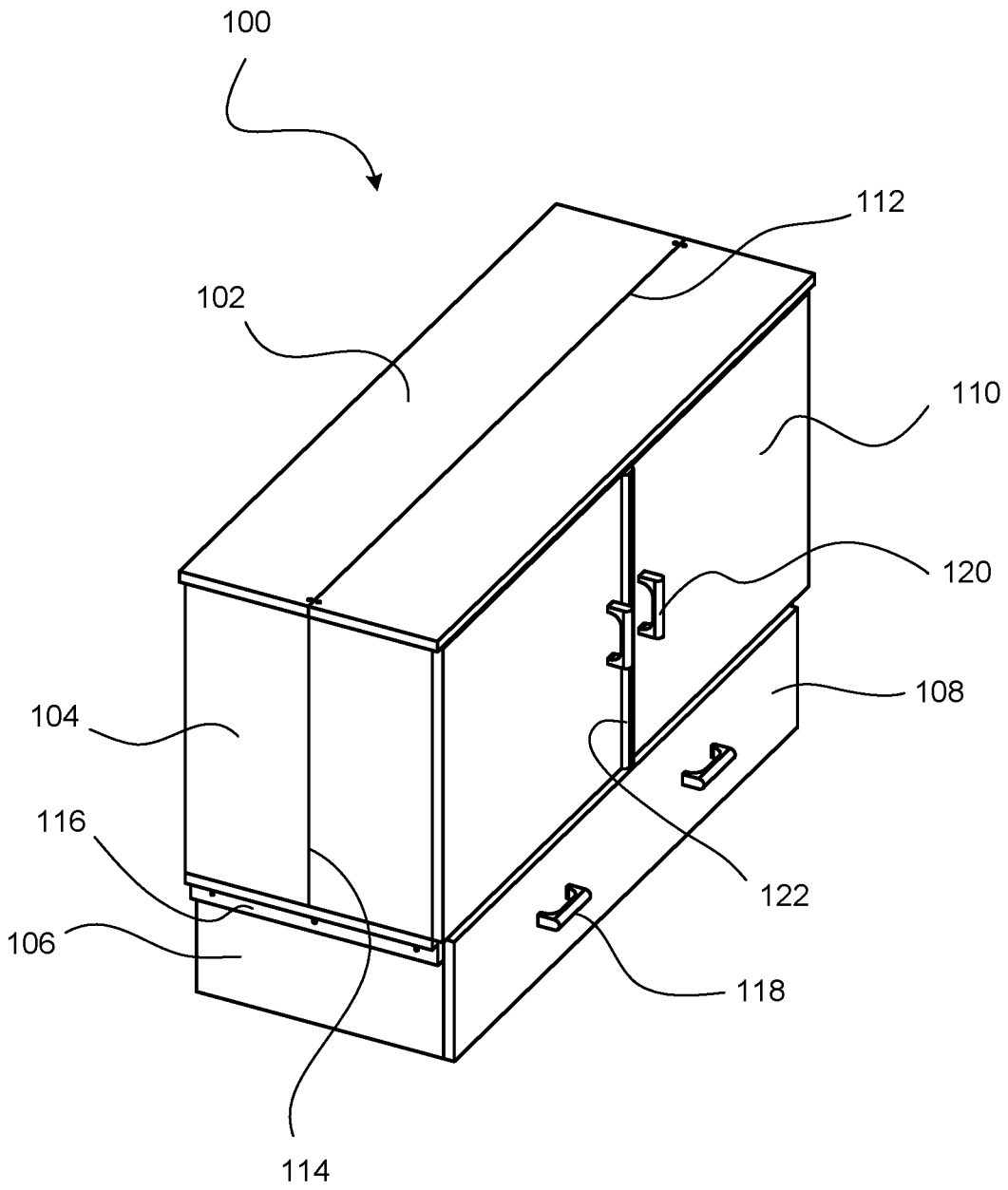
FIG. 1 is a perspective view of an embodiment of the invention in a closed position.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

With reference to FIGS. 1-4 and 7-8, embodiment 100 is a foldout cabinet bed having a cabinet top 102, a cabinet side 104, a base side panel 106, a bottom drawer front 108 and an upper cabinet front panel 110. A hinge 112 may separate two halves of cabinet top 102 and a hinge 114 may separate two halves of cabinet side 104.

Bottom drawer front 108 may feature any knobs or handles 118 of suitable decor, which may be chosen to match handles 120 on cabinet front panel 110. The cabinet front panel 110 may further feature one or more decorative front contours 122 such as an inward bevel or an outward bevel to provide the appearance that the cabinet front panel 110 is divided into two or more sections such as cabinet doors or drawers.

The base side panels 106 in embodiment 100 are set on a smaller footprint than the top section such that cabinet sides 104 are offset therefrom. Support 116 may be used to increase stability and rigidity in the cabinet as it braces the offset difference between the location of base side panel 106 and cabinet side 104.

The top cabinet structure may be opened by rotating cabinet sides 104 outward on hinges attached to the rear cabinet panel 148 or attached to side support structures 125. The side support structures 125 have a side support base 124 and a side support top 126 that allow distribution of weight from the cabinet top 102 to be supported by the cabinet floor 146 while allowing a much more open view. When used as a bed with the rear cabinet panel 148 as a headboard, a person sleeping will be able to enjoy a much more open side view than had the cabinet sides 104 been fixed in place and/or if the side support structure 125 were not designed to support the necessary weight of the cabinet top 102 while permitting viewing therethrough.

It is to be understood that other variations of the side support structures 125 are possible, including structures that are transparent or that have one or more viewing holes therethrough, as long as they are sturdy enough to support the appropriate weight.

Figure 2:
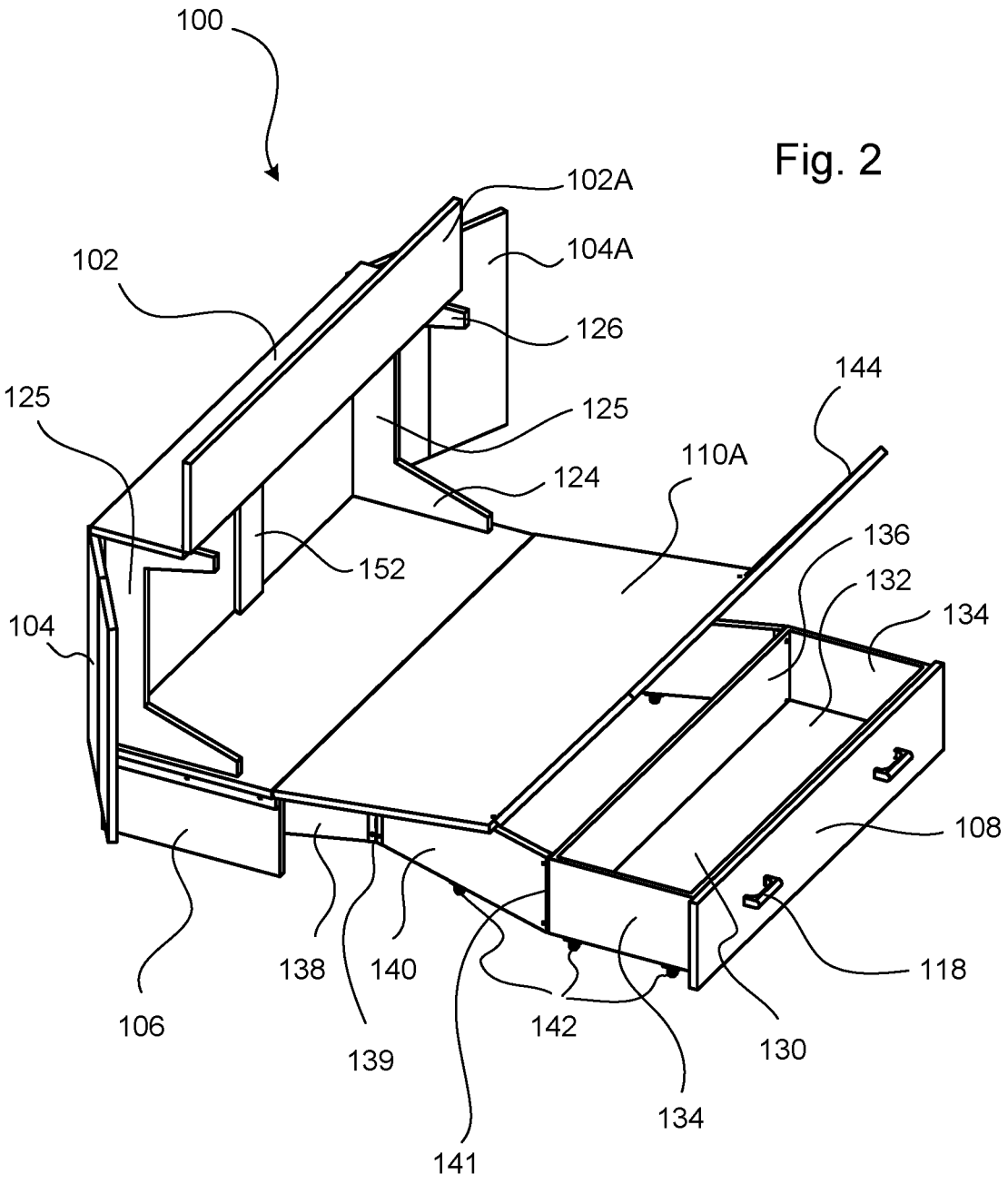
FIG. 2 is a perspective view of the embodiment of FIG. 1 in a partially open position.

In the partially open view of FIG. 2 the drawer 130 is shown having a drawer base 132, drawer sides 134 and a drawer rear face 136.

Drawer 130 is pulled out of its storage position to form a base for the bed platform. Bifold support panels 138 and 140 are attached to each other via hinge 139. Support panel 140 is also attached to drawer 130 by hinge 141. Support panel 138 is attached to the inside of base side panel 106 via hinge 149. The drawer base bottom face 132A of drawer 130 and support panels 138 and 140 have castors or wheels 142 to allow easy sliding along the floor to open and close the drawer from closed to an extended open position.

It is preferable that wheels 142 on rear extension panels 138 and 140 be able to freely rotate so that the wheels can face forward as panels 138 and 140 are rotated around hinges 141, 139 and 149.

Figure 3:
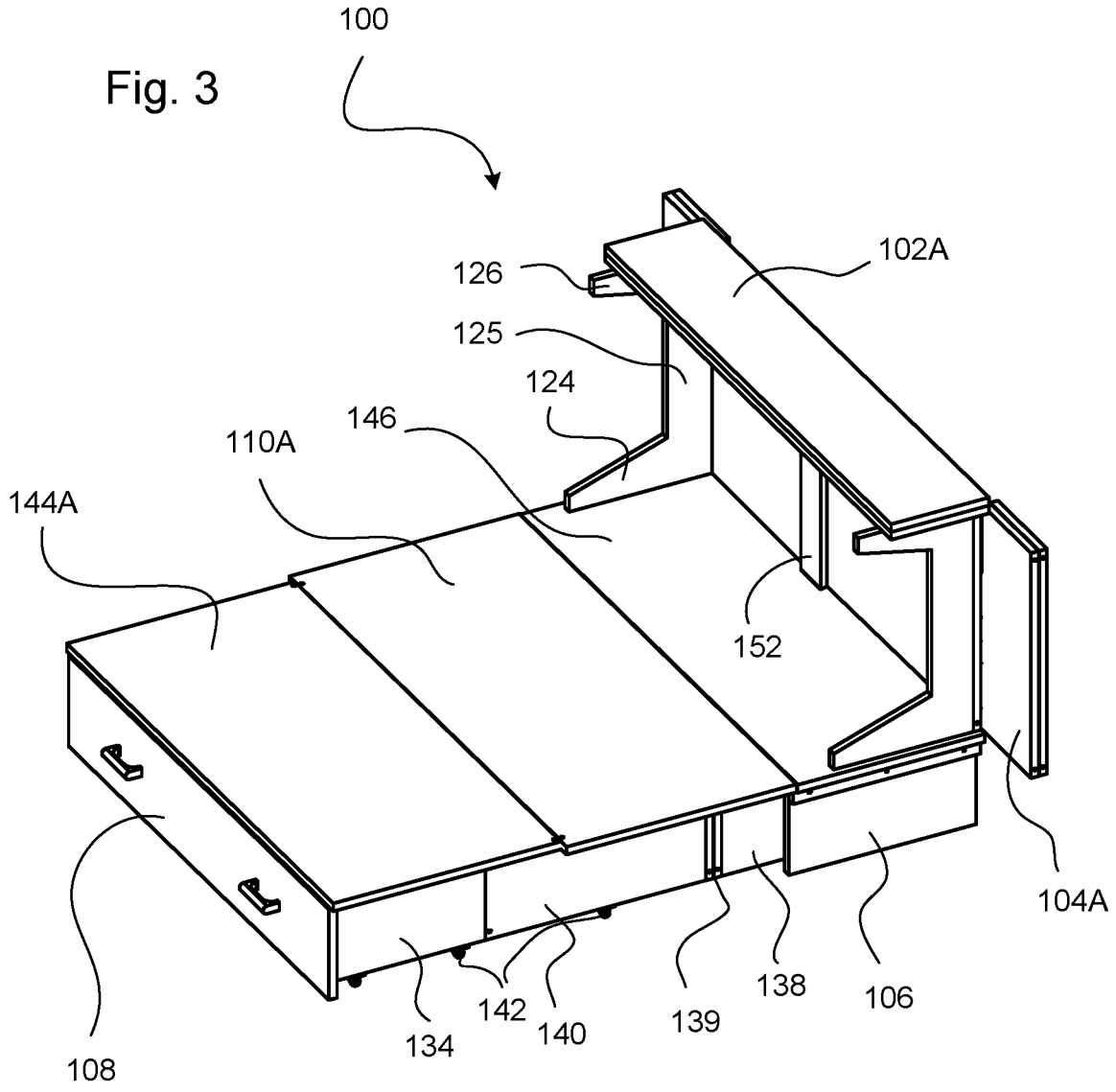
FIG. 3 is a perspective view of the embodiment of FIG. 1 in a fully open position.
Figure 4:
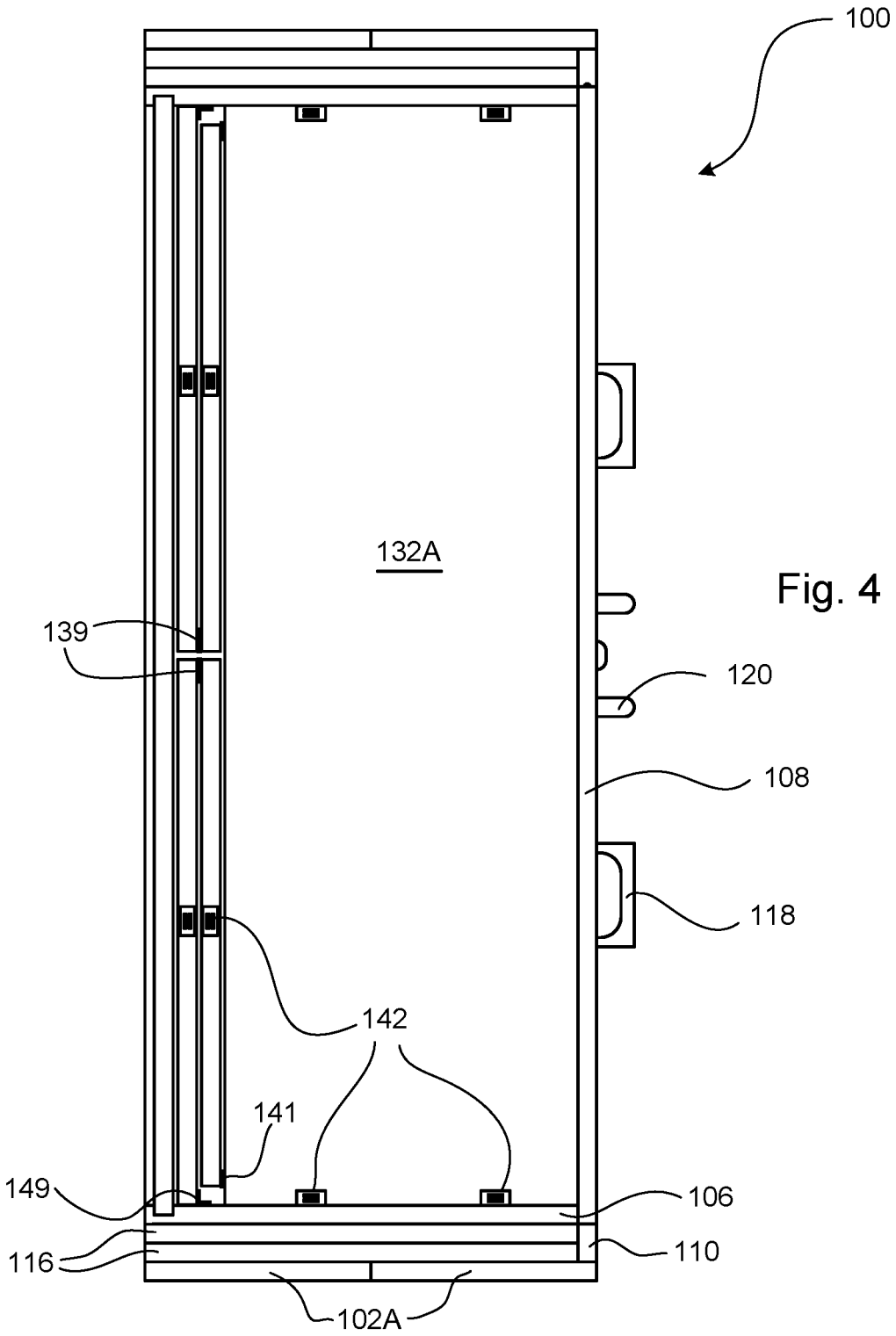
FIG. 4 is a bottom view of the embodiment of FIG. 1 in the closed position.
Figure 5:
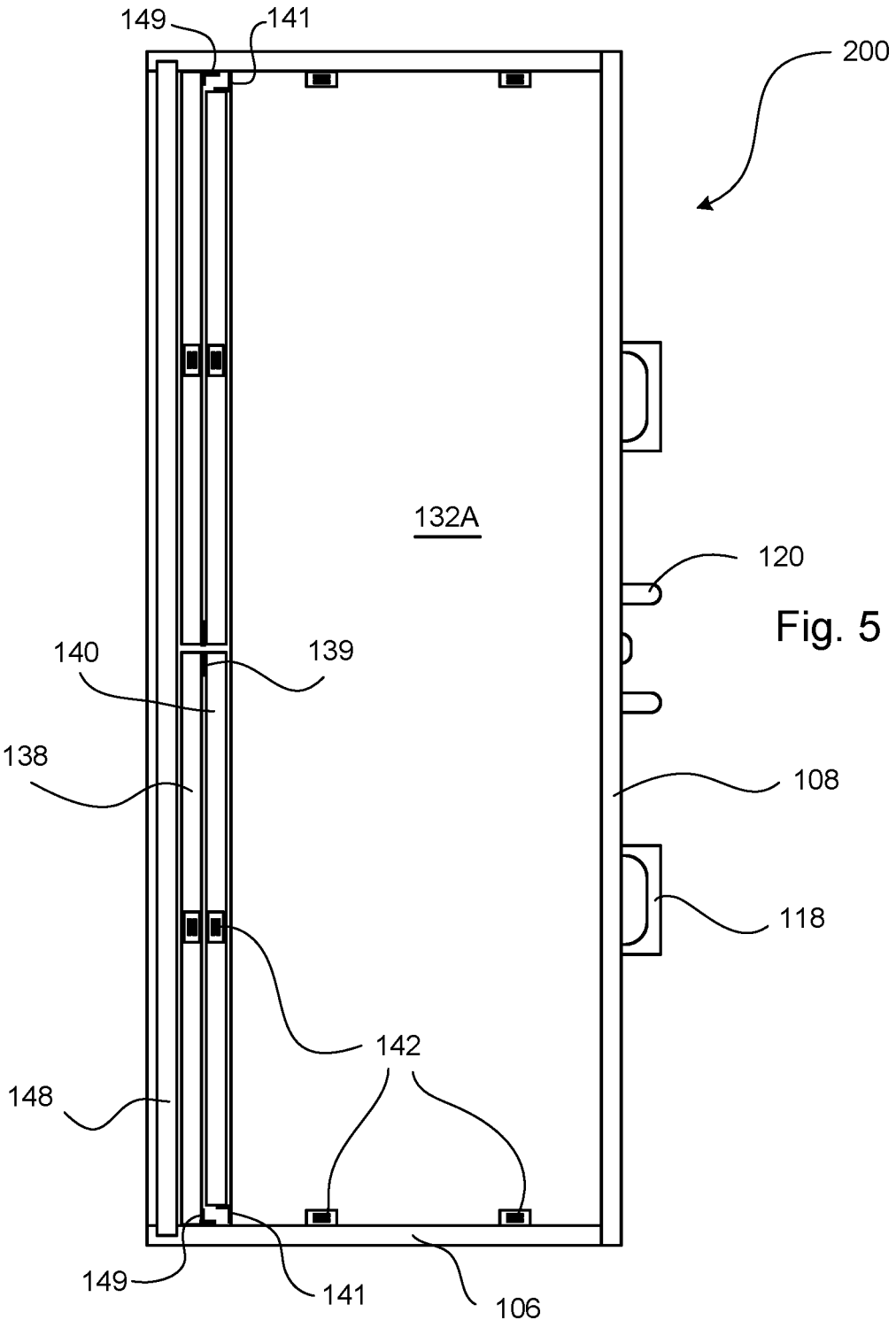
FIG. 5 is a bottom view of another embodiment of the invention in a closed position.
Figure 6:
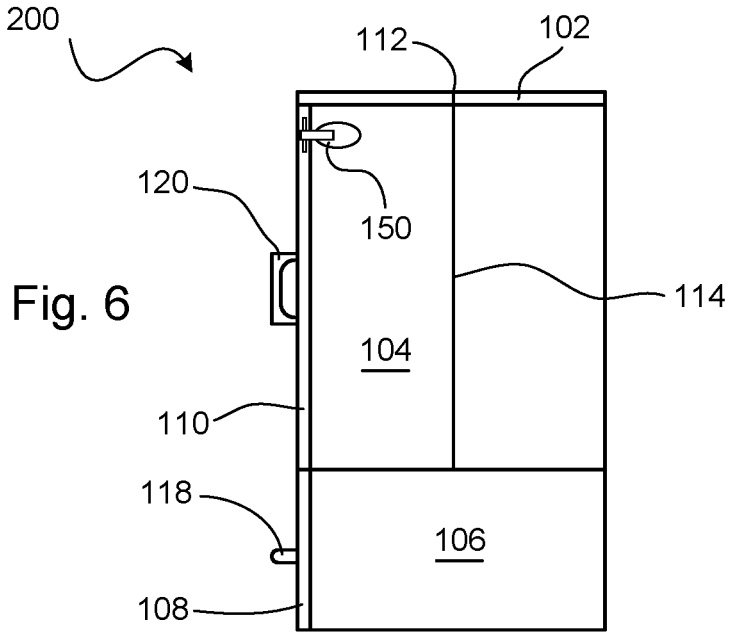
FIG. 6 is a side elevation view of the embodiment of FIG. 5 in the closed position.
Figure 7:
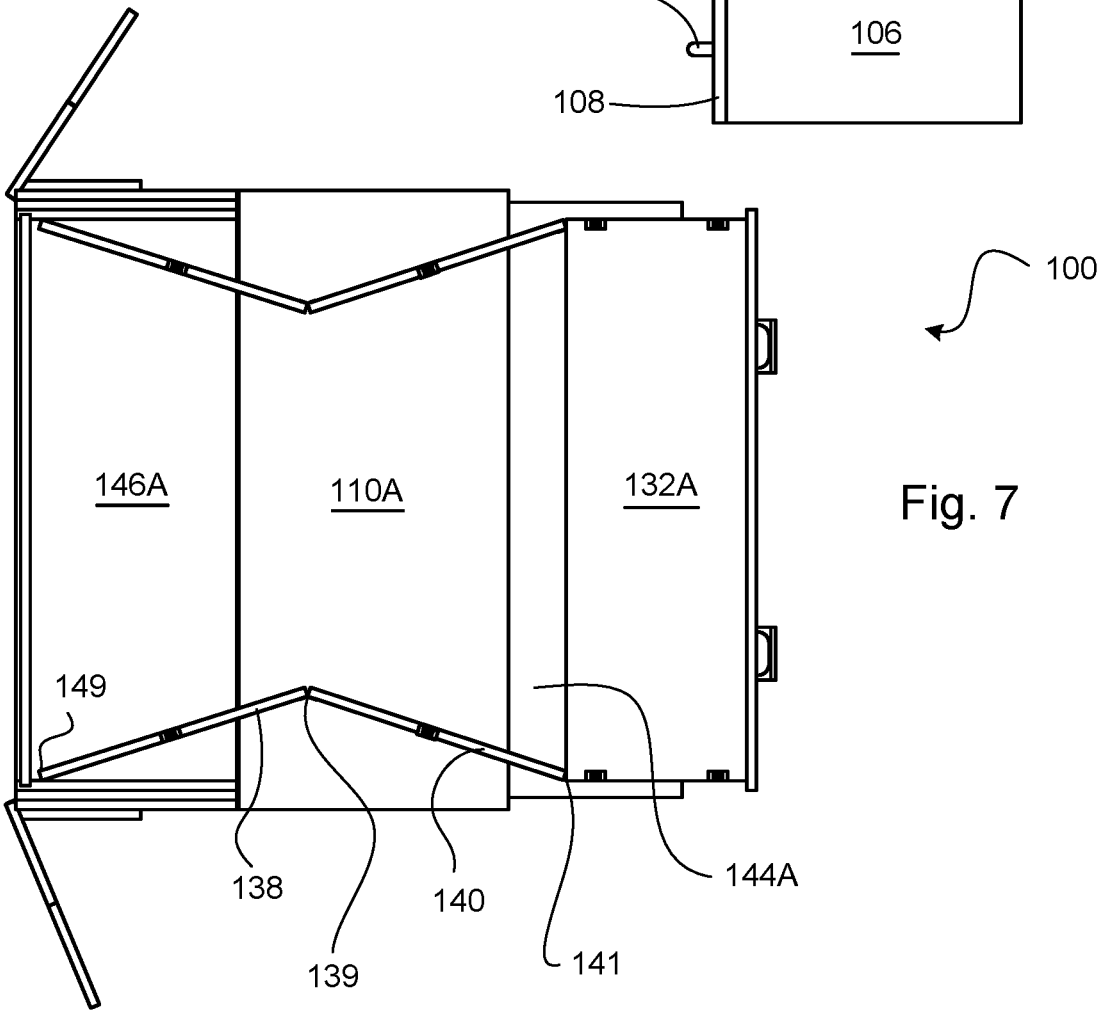
FIG. 7 is a bottom view of the embodiment of FIG. 1 in a partially open position.

The overall strength of the cabinet structure may be increased by adding central back support 152 shown in FIGS. 2 and 3.

As shown in FIGS. 2 and 3, cabinet top 102 may be rotated open around top hinge 112 to reveal the cabinet top underside 102A. In embodiment 100 the cabinet top 102 rotates completely back upon itself as shown in FIG. 3. In alternative embodiments the cabinet top 102 may only open to the 90 degree position shown in FIG. 2, for example if tension or hydraulic hinges are chosen to soften the opening and closing of the cabinet top 102.

In the open position, a mattress or suitable cushioning material for sleeping may be placed on the platform created by cabinet floor 146, the front cabinet panel underside 110A and the inside front panel underside 144A.

A mattress can be stored in the cabinet in the space between the front cabinet panel 110 and the rear cabinet panel 148 above the cabinet floor 146 and below the cabinet top 102. Any suitable mattress or similar material may be used. One option is to use a mattress made in three sections which can be hingedly attached by fabric so that it easily folds up and unfolds in sections similar in size to the sections of the platform 146, 110A and 144A.

Embodiment 200 is similar to embodiment 100 but embodiment 200 has the bottom drawer the same width as the top portion of the cabinet. Base side panel 106 is in line with cabinet side 104 above it when in the closed position. This embodiment features additional space in bottom drawer 130 which allows for additional storage of pillows and bedding.

The addition of fastening mechanism 150 such as easy to operate latches or bolts allow cabinet sides 104 to be securely fastened to front cabinet panel 110 such that there would be no danger of front cabinet panel 110 falling open, which might otherwise result in injury or an untidy appearance. Fastening mechanism 150 may be on the cabinet side inside 104A instead or in addition to being on the cabinet side 104.

Fasteners 152 such as screws, glue or rivets can be used to hold various pieces together, including hinges and panels as appropriate.

Additional touches can be added to the apparatus to improve ease of use and/or reduce wear on the parts. For example the topmost surface of the rear extension panels 138 and 140 and the topmost surface of drawer sides 134 and drawer rear face 136 may be coated with felt or other soft surface to reduce sound and to reduce wear on the front cabinet panel 110 and the inside front panel 144. Further, a handle may be added to inside front panel 144 to assist in folding the bed back into a cabinet. The handle on inside front panel 144 would be positioned to face downward in the open position and located in a position that it would not touch the rear extension panels 138 and 140 or any part of the drawer 130.

Figure 8:
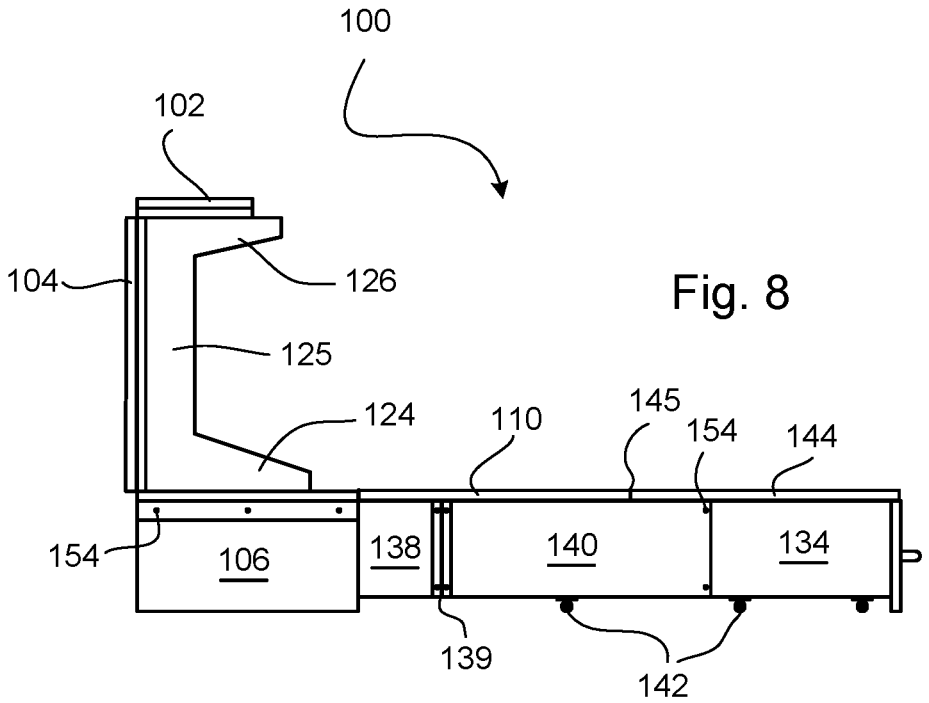
FIG. 8 is a side elevation view of the embodiment of FIG. 1 in a fully open position.

To transition embodiments 100 and 200 between a closed cabinet position as shown in FIG. 1 and an open bed position, for example, as shown in FIG. 3 or 8, a user may begin by pulling out the base drawer 130 and by unlocking a locking mechanism that secures a front cabinet panel 110 to a side panel 104. These steps can occur in either order. When the base drawer 130 is pulled out, the user may remove pillows and bedding from the drawer. The front cabinet panel is folded down onto the topmost surface of the rear extension panels 138 and 140. The inside front panel 144 is folded down onto the base drawer 130. A flat platform is formed out of the front cabinet panel 110, the inside front panel 144 and the cabinet floor 146. A folded mattress stored within the cabinet can be unfolded and laid onto the flat platform. The cabinet side panels 104 can be unfolded to reduce visible obstructions.

The topmost surface of the rear extension panels 138, 140 may be provided with a felt pad upon which the unfolded flat platform can rest.

A cabinet top panel 102 can be unfolded to further reduce visible obstructions. Pulling out the base drawer 130 is performed by rolling the base drawer 130 on a floor. The bed can be made by putting bedding stored in the drawer 130 on the mattress and placing pillows stored in the drawer 130 on the bed.

The step of pulling out the base drawer 130 may involve unfolding rear extension panels 138, 140 hingedly connecting the base drawer 130 to a side base panel 106. In the alternative, the step of pulling out the base drawer 130 could involve extending telescopic rails connecting the base drawer 130 to a rear cabinet panel 148 or to a base side panel 106 as is known in the art, for example as disclosed by Arason.

When unfolding the inside front panel 144 onto the base drawer 130 a handle secured to the inside front panel 144 can be gripped to assist in pivoting the front panel 144 towards the base drawer 130.

As will be apparent to those skilled in the art in the light of the foregoing disclosure the present invention is not limited by what has been particularly shown and described herein. Rather the scope of the present invention includes both combinations and sub-combinations of the features described hereinabove as well as modifications and variations thereof which would occur to a person of skill in the art upon reading the foregoing description and which are not in the prior art. Furthermore, many alterations and modifications are possible in the practice of this invention without departing from the spirit or scope thereof. Accordingly, the scope of the invention is to be construed in accordance with the substance defined by the following claims.

What is claimed is:

1. Apparatus for transforming between a bed and a cabinet, comprising:

a rear cabinet panel, a cabinet top attached to said rear cabinet panel along a top edge of the rear cabinet panel;

a cabinet floor with a rear end and a front end, and with a first side and a second side opposite the first side, wherein the first side and the second side each extend in a first direction away from the rear cabinet panel;

a first cabinet side attached to the rear cabinet panel along a first side edge of the rear cabinet panel, wherein the first cabinet side is extendable in the first direction along the first side of the cabinet floor;

a second cabinet side attached to the rear cabinet panel along a second side edge, of the rear cabinet panel, opposite the first side edge, wherein the second cabinet side is extendable in the first direction along the second side of the cabinet floor; and a sleeping section that is movable from an initial position to a horizontal position in which the sleeping section is parallel with the cabinet floor, wherein when the sleeping section is in the horizontal position the cabinet floor and the sleeping section are arranged to together support a mattress;

wherein at least one part of the first cabinet side has a first end and a second end, wherein the second end is movable relative to the rear cabinet panel from a first position to a second position, wherein when the second end is in the first position the at least one part extends in the first direction from the first end toward the second end along the first side of the cabinet floor such that the second end is further from the rear cabinet panel in the first direction than the first end, and wherein when the second end is in the second position the at least one part extends at an oblique angle relative to the rear cabinet panel; and wherein when the second end of the at least one part is in the first position, the first end of the at least one part is closer than the front end of the cabinet floor to the rear cabinet panel.

2. The apparatus of claim 1, wherein when in the first position the at least one part of the first cabinet side is orthogonal to the rear cabinet panel and the cabinet floor, and when in the second position the at least one part of the first cabinet side is orthogonal to the cabinet floor and extends at an oblique angle relative to the rear cabinet panel.

3. The apparatus of claim 1, wherein at least one part of the second cabinet side has a first end and a second end, wherein the second end is movable relative to the rear cabinet panel from a first position to a second position, wherein when the second end is in the first position the at least one part extends in the first direction from the first end toward the second end along the second side of the cabinet floor such that the second end is further from the rear cabinet panel in the first direction than the first end, and wherein when the second end is in the second position the at least one part extends at an oblique angle relative to the rear cabinet panel.

4. The apparatus of claim 1, wherein the first cabinet side and the second cabinet side are hingedly coupled to the rear cabinet panel.

5. The apparatus of claim 1, wherein another part of the first cabinet side is movable relative to the rear cabinet panel, and the at least one part of the first cabinet side is movable relative to the another part of the first cabinet side.

6. The apparatus of claim 5, wherein the at least one part of the first cabinet side is hingedly coupled to the another part of the first cabinet side.

7. The apparatus of claim 5, wherein the another part of the first cabinet side is hingedly coupled to the rear cabinet panel, and the at least one part of the first cabinet side is hingedly coupled to the another part of the first cabinet side.

8. The apparatus of claim 5, wherein another part of the second cabinet side is movable relative to the rear cabinet panel, and the at least one part of the second cabinet side is movable relative to the another part of the second cabinet side.

9. The apparatus of claim 8, further comprising:

a first hinge bisecting the first cabinet side; and a second hinge bisecting the second cabinet side;

wherein the first cabinet side and the second cabinet side are hingedly coupled to the rear cabinet panel.

10. The apparatus of claim 1, wherein the at least one part of the first cabinet side is hingedly coupled to the rear cabinet panel such that the at least one part of the first cabinet side is movable between the first position and the second position.

11. The apparatus of claim 1, further including:

a base comprising:

a drawer receiving opening; and a drawer that is movable from a closed drawer position within the drawer receiving opening to an open drawer position at least partially outside of the drawer receiving opening, wherein when the drawer is in the open position and the sleeping section is in the horizontal position the drawer would support an underside of the sleeping section.

12. The apparatus of claim 11, wherein the base further includes:

a peripheral support that supports the cabinet floor;

a movable sleeping section support that includes:

a first extension panel, wherein one end of the first extension panel is hingedly coupled to the peripheral support; and a second extension panel, wherein one end of the second extension panel is hingedly coupled to another end of the first extension panel;

wherein when the drawer is in the closed drawer position the drawer is under the cabinet floor, and wherein the drawer is hingedly coupled to another end of the second extension panel.

13. The apparatus of claim 1, wherein the cabinet top is orthogonal to the rear cabinet panel and orthogonal to the first cabinet side and the second cabinet side; and wherein the first cabinet side and the second cabinet side are each orthogonal to the rear cabinet panel.

14. The apparatus of claim 1, wherein, the movable sleep section comprises: a front cabinet panel hingedly attached along a bottom edge to the cabinet floor, and an inside front panel hingedly attached along a top edge to the front cabinet panel, the front cabinet panel and the inside front panel being moveable between a closed cabinet position orthogonal to the cabinet floor and the cabinet top and parallel to the rear cabinet panel to an open cabinet position parallel to the cabinet floor and the cabinet top and orthogonal to the rear cabinet panel.

15. The apparatus of claim 14, wherein when the front cabinet panel and the inside front panel are in the closed cabinet position, the entire first cabinet side and the entire second cabinet side are rearward of a major rearward facing surface of the front cabinet panel.

16. The apparatus of claim 1, further comprising:

a first hinge bisecting the first cabinet side; and a second hinge bisecting the second cabinet side.

17. Apparatus for transforming between a bed and a cabinet, comprising:

a cabinet portion including:

a rear cabinet panel, a cabinet top attached to said rear cabinet panel along a top edge of the rear cabinet panel, a cabinet floor, a first side support that supports an underside of a first side of the cabinet top; and a second side support that supports the underside of a second side of the cabinet top, wherein the second side is opposite the first side;

wherein the first side support includes a first see-through portion that is arranged to permit a line of sight from an interior of the cabinet portion through the first see-through portion, and wherein the first side support is C-shaped and the first see-through portion is a through hole opening; and a sleeping section that is movable from a first position to a second position in which the sleeping section is parallel with the cabinet floor, wherein when the sleeping section is in the second position the cabinet floor and the sleeping section are arranged to together support a mattress.

18. The apparatus of claim 17, wherein the second side support includes a second see-through portion that is arranged to permit a line of sight from the interior of the cabinet portion through the second see-through portion.

19. The apparatus of claim 17, wherein the first see-through portion is a transparent material.

20. Apparatus for transforming between a bed and a cabinet, comprising:

a rear cabinet panel, a cabinet top attached to said rear cabinet panel along a top edge of the rear cabinet panel;

a cabinet floor with a rear end and a front end, and with a first side and a second side opposite the first side, wherein the first side and the second side each extend in a first direction away from the rear cabinet panel;

a first cabinet side attached to the rear cabinet panel along a first side edge of the rear cabinet panel, wherein the first cabinet side is extendable in the first direction along the first side of the cabinet floor;

a second cabinet side attached to the rear cabinet panel along a second side edge, of the rear cabinet panel, opposite the first side edge, wherein the second cabinet side is extendable in the first direction along the second side of the cabinet floor; and a base that includes:

a peripheral support that supports the cabinet floor;

a movable sleeping section support that includes:

a first extension panel, wherein one end of the first extension panel is hingedly coupled to the peripheral support;

a second extension panel, wherein one end of the second extension panel is hingedly coupled to another end of the first extension panel; and a drawer that is movable from a first drawer position under the cabinet floor to a second drawer position, wherein the drawer is hingedly coupled to another end of the second extension panel;

wherein at least one part of the first cabinet side has a first end and a second end, wherein the second end is movable relative to the rear cabinet panel from a first position to a second position, wherein when the second end is in the first position the at least one part extends in the first direction from the first end toward the second end along the first side of the cabinet floor such that the second end is further from the rear cabinet panel in the first direction than the first end, and wherein when the second end is in the second position the at least one part extends at an oblique angle relative to the rear cabinet panel; and wherein when the second end of the at least one part is in the first position, the first end of the at least one part is closer than the front end of the cabinet floor to the rear cabinet panel.

21. The apparatus of claim 20, wherein when the drawer is in the first drawer position the first extension panel and the second extension panel are parallel to one another and the rear cabinet panel, and when the drawer is in the second drawer position the first extension panel and the second extension panel are parallel to one another and orthogonal to the rear cabinet panel.

22. The apparatus of claim 20, wherein the movable sleeping section support includes:

a third extension panel, wherein one end of the third extension panel is hingedly coupled to the peripheral support;

a fourth extension panel, wherein one end of the fourth extension panel is hingedly coupled to another end of the third extension panel; and wherein the second extension panel is hingedly coupled to one side of the drawer and the fourth extension panel is hingedly coupled to another side of the drawer.

23. The apparatus of claim 22, wherein when the drawer is in the first drawer position the third extension panel and the fourth extension panel are coplanar with the first extension panel and the second extension panel, respectively, and when the drawer is in the second drawer position the third extension panel and the fourth extension panel are parallel to the first extension panel and the second extension panel, respectively.

24. The apparatus of claim 23, wherein the drawer has a front drawer face, a rear drawer face, two side drawer faces, and a drawer base orthogonal to the front, rear, and side drawer faces; and wherein the second and fourth extension panels are hingedly attached to the rear drawer face.

25. The apparatus of claim 20, further including a movable sleep section that comprises: a front cabinet panel hingedly attached along a bottom edge to the cabinet floor, and an inside front panel hingedly attached along a top edge to the front cabinet panel, the front cabinet panel and the inside front panel being moveable between a closed cabinet position orthogonal to the cabinet floor and the cabinet top and parallel to the rear cabinet panel to an open cabinet position parallel to the cabinet floor and the cabinet top and orthogonal to the rear cabinet panel.

26. The apparatus of claim 25, wherein when the drawer is in the second position and the front panel and the extension panel are parallel with the cabinet floor, the drawer would be underneath the extension panel.

* * * * *